US006910452B2

(12) United States Patent
Motohashi

(10) Patent No.: US 6,910,452 B2
(45) Date of Patent: Jun. 28, 2005

(54) ROCKER ARM

(75) Inventor: Nobutsuna Motohashi, Hamura (JP)

(73) Assignee: Koyo Seiko Co., Ltd., Osaka (JP)

( * ) Notice: Subject to any disclaimer, the term of this patent is extended or adjusted under 35 U.S.C. 154(b) by 0 days.

(21) Appl. No.: 10/701,615

(22) Filed: Nov. 6, 2003

(65) Prior Publication Data

US 2004/0089256 A1 May 13, 2004

(30) Foreign Application Priority Data

Nov. 7, 2002 (JP) ..... P2002-323359

(51) Int. Cl.[7] ..... F01L 1/18
(52) U.S. Cl. ..... 123/90.44; 123/90.39
(58) Field of Search ..... 123/90.44, 90.39

(56) References Cited

U.S. PATENT DOCUMENTS 5,123,384 A * 6/1992 Abbas ..... 123/90.39
5,678,459 A * 10/1997 Motohashi et al. ..... 74/559

FOREIGN PATENT DOCUMENTS

JP 04308307 A * 10/1992 ..... F01L/1/18
JP 05-033611 2/1993
JP 05-272310 10/1993
JP 06-108809 4/1994
JP 07-011919 1/1995
JP 09-91831 4/1997
JP 2001-47180 2/2001
JP 2001-191139 7/2001
JP 2002-195011 7/2002

OTHER PUBLICATIONS

European Search Report dated Feb. 13, 2004.

* cited by examiner

*Primary Examiner*—Thomas Denion
*Assistant Examiner*—Zelalem Eshete
(74) *Attorney, Agent, or Firm*—McGinn & Gibb, PLLC

(57) ABSTRACT

In order to improver a response of a rocker arm by reducing a moment of inertia of the rocker arm around a pivot portion thereof, the invention provides a rocker arm comprises a metal-plate-made rocker arm main body including a pivot portion and a valve stem guide portion respectively formed in the longitudinal-direction two end portions thereof. In the provided rocker arm, the center-of-gravity position of the rocker arm main body is set at a position shifted to the pivot portion side from the longitudinal-direction center thereof. Moreover, The clearance between a pair of opposing side wall portions formed in the valve stem guide portion is set narrow so that the center-of-gravity of the rocker arm main body can be set at a position shifted to the pivot portion side from the longitudinal-direction center thereof.

7 Claims, 5 Drawing Sheets

ROCKER ARM

BACKGROUND OF THE INVENTION

1. Field of the Invention

The present invention relates to a rocker arm for opening and closing a valve disposed on a cylinder head in accordance with the sliding operation of a can.

2. Description of the Related Art

Conventionally, there is known a rocker arm which is made by casting according to a lost wax process. However, since the thus-cast rocker arm is great in weight, there is proposed a rocker arm which is made of a metal plate and is thereby reduced in weight (For example, see patent literature 1.).

Here, FIGS. 8 to 10 show an example of a conventional metal-plate-made rocker arm 81 of an end pivot type.

The rocker arm 81 comprises a main body 82, a support shaft 83, a roller 64, and a plurality of needle-shaped rollers 85.

The main body 82 includes a pair of side walls 86, 87, a pivot portion 88 with which a rush adjuster can be contacted, and a valve stem guide portion 89 with which the stem end of a valve can be contacted. Between the pair of side walls 86, 87, there is interposed the support shaft 83 so as to extend between them; and, on the outer periphery of the support shaft 83, there is rotatably supported the roller 84 with which a cam can be contacted through the plurality of needle-shaped rollers 85.

[Patent Literature]

JP-Application-9-91831

In the case of the conventional metal-plate-made 10 rocker arm 81, the pivot portion 88 is formed integrally with the pair of side walls 86, 87, whereas the valve step guide portion 89 is produced as a separate member and is then laser welded to the pair of side walls 86, 87.

As described above, since the pivot portion 88 is formed integrally with the pair of side walls 86, 87, the thickness of the periphery of the pivot portion 88 can be reduced, thereby being able to reduce the weight of the rocker arm 81 accordingly.

However, the weight of the periphery of the valve stem guide portion 89 is large due to the laser welding, so that the position of center-of-gravity of the rocker arm 81 becomes near to the valve stem guide portion 89.

Because the position of center-of-gravity of the rocker arm 81 is made to lie near to the valve stem guide portion 89, the moment of inertia around the pivot portion 88 serving as a fulcrum is large, which lowers the response performance of the rocker arm 81 when it is in use.

SUMMARY OF THE INVENTION

Therefore, to solve this problem, the conventional rocker arm of a welding type has been required to be able to provide the moment of inertia as small as that of the conventional cast rocker arm while reducing the weight thereof as a whole.

In eliminating the above problems, according to the invention, there is provided a rocker arm comprising a metal-plate-made rocker arm main body, the rocker arm main body including a pivot portion and a valve stem guide portion respectively formed in the longitudinal-direction two end portions thereof, wherein the position of the center-of-gravity of the rocker arm main body is disposed at a position shifted to the pivot portion side from the longitudinal-direction center thereof.

Actually, in the layout stage of an engine, the support shaft position (cat position), the pivot portion position (rush adjuster position) and the valve stem guide portion position (valve position) are set. According to the invention, the rocker arm comprises a metal-plate-made rocker arm main body including a pair of opposing side wall portions arranged substantially in parallel to each other, a pivot portion and a valve stem guide portion respectively formed integrally with the longitudinal-direction two end portions of the two opposing side wall portions so as to extend between them; and also, in the present rocker arm, in order that the position of the center-of-gravity of the rocker arm main body can be disposed at a position shifted to the pivot portion side from the longitudinal-direction center thereof, the clearance between the pair of mutually opposing side wall portions in the valve stem guide portion is set narrow. Specifically, in the developed plane shape of the rocker arm main body (see FIG. 2), the area of the lock arm main body or the plate thickness thereof is adjusted so that, in the longitudinal-direction position of the rocker arm main body that passes through the center-of-gravity thereof, the pivot portion side and valve stem guide portion side can be equal in weight to each other.

According to the rocker arm of the invention, since the position of the center-of-gravity of the rocker arm main body is disposed at a position shifted to the pivot portion side from the longitudinal-direction center thereof, the center-of-gravity of the rocker arm lies nearer to the pivot portion side. This can reduce the moment of inertia around the pivot portion serving as a fulcrum, thereby being able to enhance the response performance of the rocker arm.

Thanks to the above structure, since the valve stem guide portion is formed integrally with the metal-plate-made rocker arm main body, when compared with a structure in which a valve stem guide portion is welded to a rocker arm main body, the weight of the rocker arm can be reduced.

Figure 1:
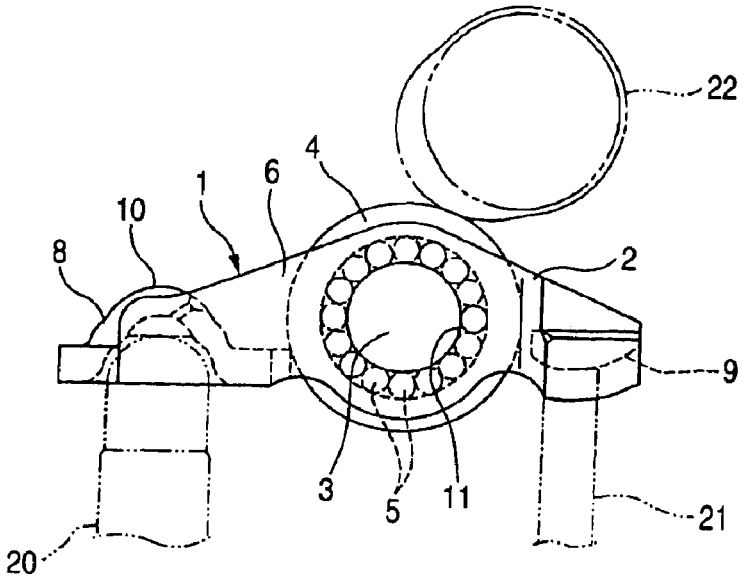
FIG. 1 is a side view of a rocker arm according to an embodiment of the invention.

In the drawings, the reference numeral 1 refers to a rocker arm; 2 to a main body; 3 to a support shaft; 4 to a roller; 5 to a needle-shaped roller; 6, 7 to an Opposing side wall portions; 8 to a pivot portion; and 9 to a valve stem guide portion.

DETAILED DESCRIPTION OF THE PREFERRED EMBODIMENTS

Now, description will be given below of an embodiment of the invention with reference to FIGS. 1 to 7.

FIG. 1 shows a rocker arm 1 of an end pivot type. This rocker arm 1 comprises a main body 2, a support shaft 3, a roller 4, and a plurality of needle-shaped rollers 5.

The arm lock main body 2 is composed of a press-worked metal plate having a structure which includes a pair of opposing side wall portions 6, 6 disposed opposed to and substantially parallel to each other, a pivot portion 8 interposed between the lower sides of the longitudinal-direction first end portions of the two opposing side wall portions 6, 7, and a valve stem guide portion 9 interposed between the longitudinal-direction second end portions of the two opposing side wall portions 6, 7.

On the pivot portion 8, there is disposed a semispherical-shaped pivot 10 which swells out upwardly.

The valve stem guide portion 9 is formed to have a vertically inverted recessed shape when it is viewed from the end face thereof. The ceiling portion of the valve stem guide portion 9 is swollen out and curved downwardly.

In the longitudinal-direction middle portions of the two opposing side wall portions 6, 7, there are formed penetration holes 11, 12 having a common axis. In case where the two ends of the support shaft 3 are respectively inserted into the penetration holes 11, 12 and are struck for calking, the support shaft 3 can be mounted on the two opposing side wall portions 6, 7 in such a manner that it extends between and through the two opposing side wall portions 6, 7. Between the two opposing side walls 6, 7, on the outer periphery of the support shaft 3, there is rotatably disposed the roller 4 through the plurality of is needle-shaped rollers 5.

By the way, the support shaft 3 is made of e.g. high carbon chromium bearing steel or carbon steel; and, a thermally hardening treatment is enforced on the raceway surface of the support shaft 3 except for the two end portions thereof. This thermally hardening treatment can be carried out using various known techniques such as carburization hardening and induction hardening in such a manner that the surface hardness of the support shaft 3 is set for 58 or higher according to the Rockwell hardness (HRC).

In the thus-structured rocker arm 1, the pivot 10 of the main body 2 is engaged with the upper end of a rush adjuster 20 which is disposed on a cylinder head (not shown), the valve stem guide portion 9 is contacted with the stem end of a valve 21 included in a valve mechanism which is disposed on the cylinder head, and a cam 22 to be disposed on the cylinder head is contacted with the roller 4. And, by rotating the cam 22, the main body 2 is inclined and moved with the pivot 10 as a fulcrum and thus the valve stem guide portion 9 is repeatedly displaced up and down with a given stroke, thereby being able to open and close the valve 21. In this manner, the rocker arm 1 can be inclined and moved with the longitudinal-direction one end side of the main body 2 as a fulcrum.

Here, description will be given below of the is procedure for manufacturing the above-described main body 2.

Figure 2:
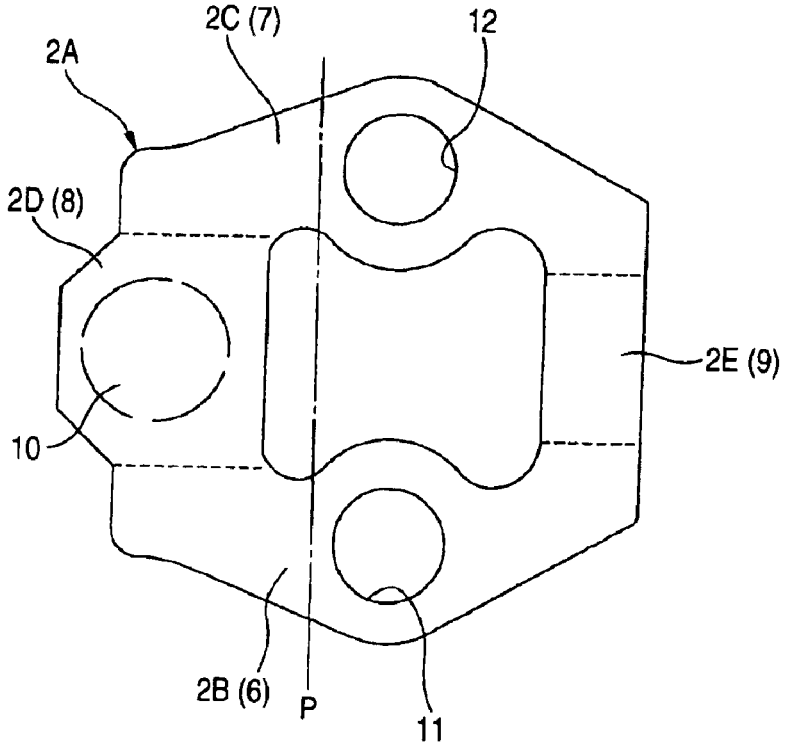
FIG. 2 is a development view of a rocker arm main body according to an embodiment of the invention.

Firstly, as shown in FIG. 2, a base plate 2A such as a piece of steel plate is blanked to thereby produce two areas 2B, 2C to be formed into the pair of opposing side walls 6, 7, an area 2D existing continuously with the first end portions of the two areas 2B, 2C to be formed into the pivot portion 8, and an area 2E existing continuously with the second end portions of the two areas 2B, 2C to be formed into the valve stem guide portion 9.

In the portions of the areas 2B, 2C into which the support shaft 3 is to be inserted, there are formed the penetration holes 11, 12. Next, a drawing operation is enforced on the area 2D to thereby form the semi-spherically-swelling pivot portion 10.

Then, after the unnecessary portions of the outer periphery of the base plate 2A are trimmed and removed, the areas 2B and 2C are respectively folded substantially into a U shape, whereby the pair of opposing side wall portions 6, 7 are disposed opposed to each other in such a manner that they are substantially parallel to each other.

And, by pressure working the area 2E which is to be formed into the valve stem guide portion 9, there can be formed the valve stem guide portion 9 which includes a stem end insertion recessed portion in the lower surface thereof. By the way, the length of the area 2E between the two opposing side wall portions 6, 7 is set shorter than the length of the area 2D, whereby the two opposing side wall portions 6, 7 are respectively drawn inwardly and thus the width of the main body 2 in the valve stem guide portion 9 becomes narrow.

Further, a thermally hardening treatment is enforced on the entire area of the main body 2.

Figure 3:
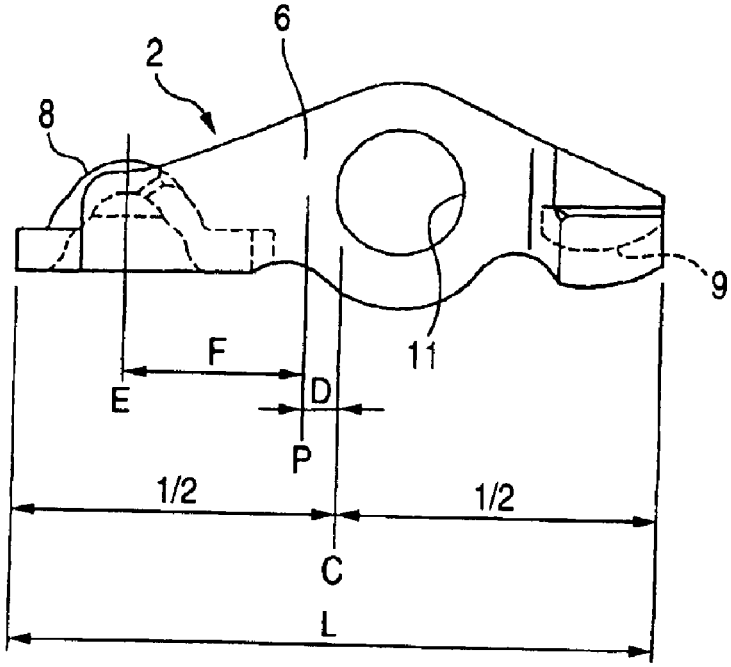
FIG. 3 is a side view of the rocker arm main body according to the embodiment of the invention.

FIG. 3 shows a side view of the thus-structured main body 2.

Since the clearance between the pair of opposing side wall portions 6, 7 in the valve stem guide portion 9 is set narrow, the weight of the valve stem guide portion 9 of the main body 2 is reduced, so that the center-of-gravity of the main body 2 is allowed to shift and lie at a position shifted to the pivot portion 8 side from the longitudinal-direction center C of the main body 2.

Specifically, the center-of-gravity of the main body 2 lies little to the side of the pivot portion 8 by a length dimension D from the longitudinal-direction center C of the main body 2. For example, in case where the length of the main body. L is 42.8 [mm], the length dimension from the two ends of the main body 2 to the center C thereof is 21.4 [mm] which is half as large as the length of the main body 2; and, therefore, the length dimension D is as follows.

$$D=1.4\ [\mathrm{mm}]$$

Also, a length dimension F from the pivot center E to the center-of-gravity P is as follows.

$$F=13.0\ [\mathrm{mm}]$$

After then, the roller 4 having the needle-shaped rollers 5 is interposed between the pair of opposing side wall portions 6, 7, the support shaft 3 is inserted into the penetration holes 11, 12 of the two opposing side wall portions 6, 7 and also into the center hole of the roller 4, and the two ends of the support shaft 3 are calked and fixed to the two opposing side wall portions 6, 7.

As a result of this, the support shaft 3 is held in such a manner that it is prevented against rotation by the two opposing side wall portions 6, 7, and the roller 4 fitted with the outer surface of the support shaft 3 through the needle-shaped rollers 5 is rollably contacted with the cam 22.

Figure 4:
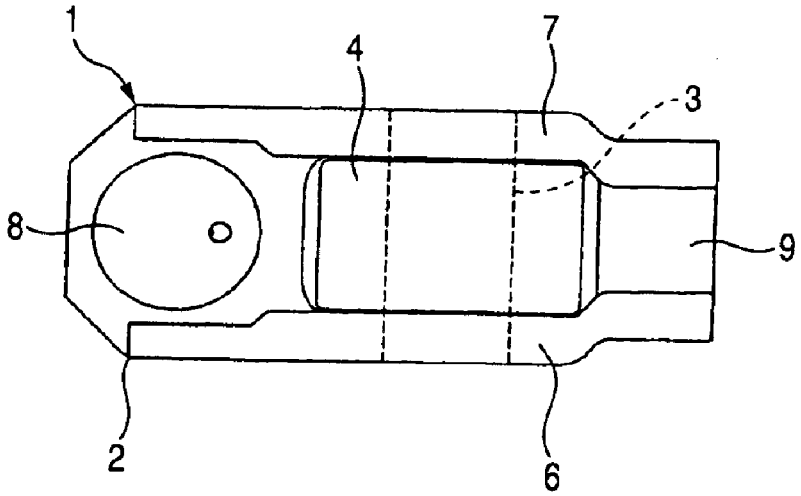
FIG. 4 is a plan view of the rocker arm according to the embodiment of the invention.
Figure 5:
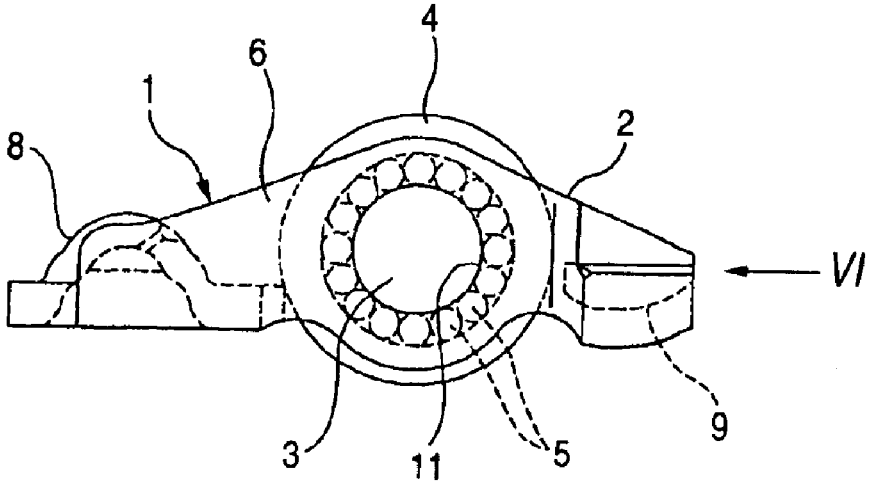
FIG. 5 is a side view of the rocker arm according to the embodiment of the invention.
Figure 6:
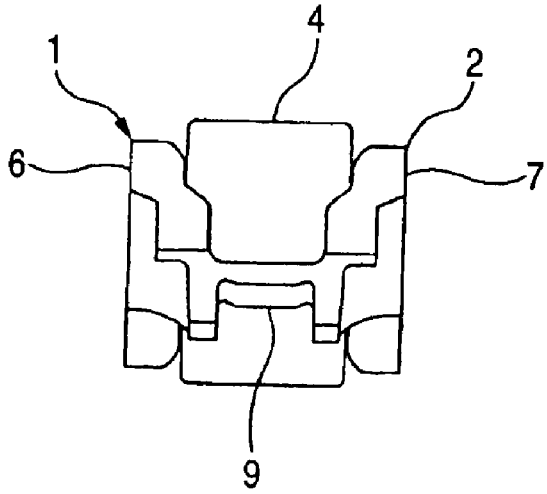
FIG. 6 is a view taken along the VI arrow mark shown in FIG. 5.

Now, FIG. 4 is a plan view of the rocker ar 1, showing a state in which the support shaft 3, roller 4 and needle-shaped rollers 5 are mounted on the main body 2; FIG. 5 is a side view of the rocker arm 1; and, FIG. 6 is a side view of the rocker arm 1, when it is viewed from the valve stem guide portion 9 side thereof.

Figure 7:
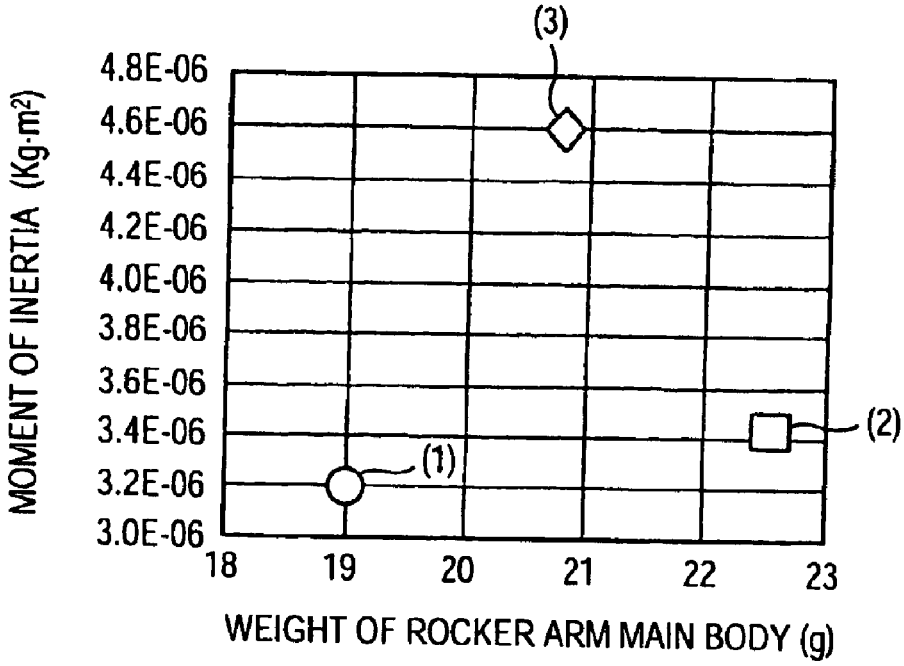
FIG. 7 is a graphical representation of the relationships between the weight and moment of inertia of the rocker arm main body according to the embodiment of the invention.
Figure 8:
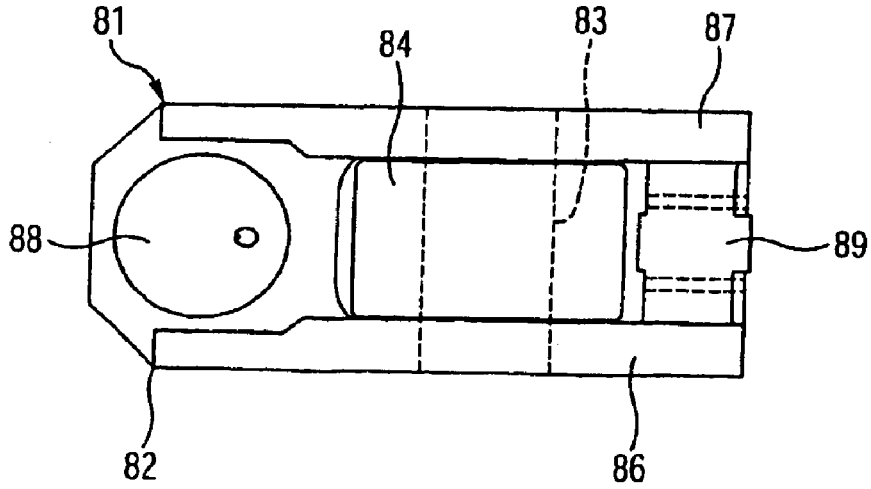
FIG. 8 PRIOR ART
FIG. 8 is a plan view of a conventional rocker arm.
Figure 9:
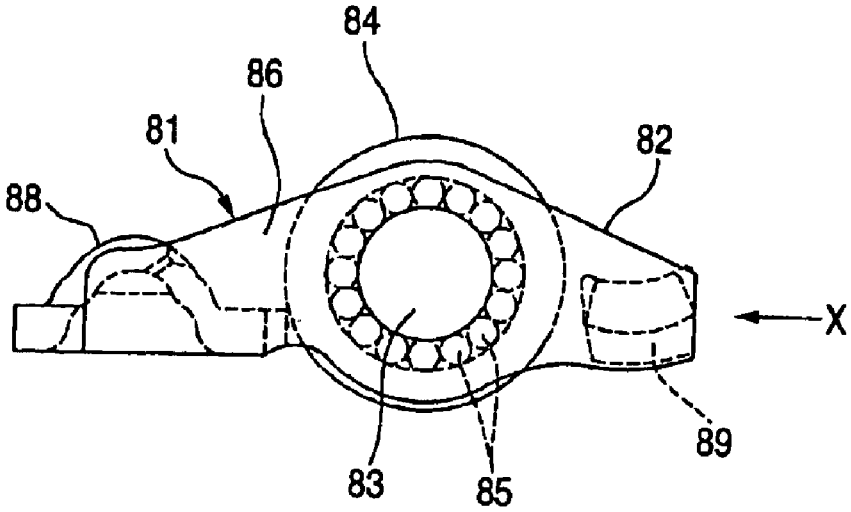
FIG. 9 PRIOR ART
FIG. 9 is a side view of the conventional rocker arm.
Figure 10:
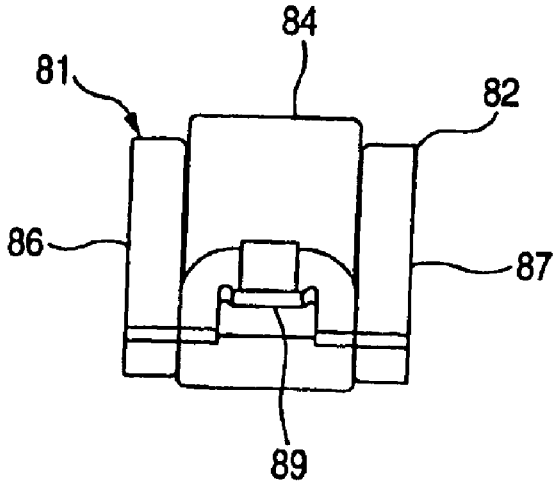
FIG. 10 PRIOR ART
FIG. 10 is a view taken from the X arrow mark shown in FIG. 9.

And, FIG. 7 is a graphical representation of the relationship between the weight [g] of the rocker arm main body and the moment of inertia [$kg \cdot m^2$] of the main body around the pivot portion thereof. In FIG. 7, (1) designates a rocker arm (of an integral type) made of a metal plate including a valve stem guide portion 9 according to the invention, (2) stands for a conventional cast rocker arm used as a comparison example, and (3) stands for a conventional metal-plate-made rocker arm (of a welding type) with a valve stem guide portion welded thereto.

TABLE 1

| | Weight (g) of rocker arm main body | Distances (mm) between center-of-gravity positions and centers of pivots | Moment of inertia ($\times 10 - 6 kg \cdot m^2$) |
|---|---|---|---|
| (1) Metal-plate (integral type) | 19 | 13.0 | 3.2 |
| (2) Casting | 23 | 12.3 | 3.4 |
| (3) Metal-plate (welding type) | 21 | 14.9 | 4.6 |

Table 1 shows an example of the relationships between the weights [g] of the rocker arm main bodies of the rocker arms (1), (2), (3), the center-of-gravity position distances [mm] from the pivot centers of the rocker arm main bodies of the rocker arms (1), (2), (3), and the moment of inertia ($kg \cdot m^2$) of the rocker arm main bodies of the rocker arms (1), (2), (3) around their respective pivots.

By the way, the moment of inertia ($kg \cdot m^2$) can be found according to the above-mentioned data, that is, weight [kg]×center-of-gravity position [$m^2$].

As can be seen clearly from Table 1 as well, the center-of-gravity position distance of the metal-plate-made rocker arm 1 (of an integral type) according to the invention from the center of the pivot is smaller than the center-of-gravity position distance of the conventional metal-plate-made rocker arm (of a welding type), and thus the center-of-gravity position of the rocker arm 1 is set at the side of the pivot portion 8 accordingly; and, as a result of this, the moment of inertia of the rocker arm 1 around the pivot is smaller than the moment of inertia of the conventional metal-plate-made rocker arm (of a welding type).

Also, Table 1 further shows the following fact. That is, although the center-of-gravity position distance of the conventional cast rocker arm is smaller than the center-of-gravity position distance of the metal-plate-made rocker arm 1 (of an integral type) according to the invention, since the weight of the conventional cast rocker arm main body is heavier than the weight of the metal-plate-made rocker arm main body (of an integral type) according to the invention, the moment of inertia of the metal-plate-made rocker arm 1 (of an integral type) around the pivot is smaller than the moment of inertia of the conventional cast rocker arm.

As described above, such reduction in the moment of inertia of the rocker arm 1 around the pivot can enhance the response performance of the rocker arm when it is in use.

Further, the weight 19 [g] of the metal-plate-made rocker arm main body 2 (of an integral type) according to the invention, in which the valve stem guide portion 9 is formed integrally with the rocker arm main body 2, is lighter than the weight 21 [g] of the conventional metal-plate-made rocker arm (of a welding type), thereby being able to reduce the weight of the rocker arm 1 over the conventional rocker arm.

By the way, the above-mentioned needle-shaped rollers 5 may not be used but the roller 4 may be sliding contacted with the support shaft 3. That is, the roller 4 may be clearance fitted directly with the outer surface of the support shaft 3, or may be fitted with the support shaft 3 through a sliding bearing.

According to the rocker arm of the invention, since the center-of-gravity position of the rocker arm main body is set at the pivot portion side from the longitudinal-direction center of the rocker arm main body, the center-of-gravity of the rocker arm is set nearer to the pivot portion. This can reduce the moment of inertia of the rocker arm around the pivot portion thereof serving as a fulcrum, thereby being able to enhance the response performance of the rocker arm.

What is claimed is:

1. A rocker arm comprising:

a rocker arm main comprising a metal plate, said rocker arm main body comprising:

a pivot portion provided on a first end side in the longitudinal direction of said rocker arm main body; and a valve stem guide portion provided on a second end side in the longitudinal direction of said rocker arm main body, wherein a center-of-gravity of the rocker arm main body is provided at a position between a central position in a longitudinal direction of said rocker arm main body and a central position of said pivot portion, wherein a moment of inertia of said rocker arm is not greater than $3.2 \times 10^{-6}$ $kg.m^2$.

2. The rocker arm according to claim 1, wherein said rocker arm main body further comprises:

a pair of opposing side wall portions arranged substantially parallel to each other, and wherein, in a longitudinal direction of the rocker arm main body, a clearance between the pair of opposing side wall portions in the valve stem guide portion is set narrower than a clearance between the pair of opposing side wall portions in other parts.

3. The rocker arm according to claim 1, wherein both of said pivot portion and said valve stem guide portion are formed integrally with said rocker arm main body.

4. The rocker arm according to claim 1, wherein said valve stem guide portion comprises:

a ceiling portion, said ceiling portion extends outward from said rocker arm main body and curves downward.

5. The rocker arm according to claim 1, wherein said rocker arm main body is thermally hardened, and wherein said rocker arm main body comprises a press-worked metal plate.

6. The rocker arm according to claim 1, further comprising:

a plurality of penetration holes disposed along a middle portion, in a longitudinal direction, of said pair of opposing side walls;

a support shaft inserted through said penetration holes, said support shaft extending through said pair of opposing side walls; and a roller rotatably disposed between said pair of opposing side walls on an outer periphery of said support shaft.

7. The rocker arm according to claim 1, further comprising:

a plurality of penetration holes disposed along a middle portion, in a longitudinal direction, of said pair of opposing side walls;

a support shaft inserted through said penetration holes, wherein said support shaft extends through said pair of opposing side walls, and wherein said support shaft comprises at least one of a high carbon chromium bearing steel and carbon steel.

* * * * *